United States Patent [19]

Furlong et al.

[11] 4,362,192

[45] Dec. 7, 1982

[54] WIRE TYING POWER TOOL

[76] Inventors: Donn B. Furlong, 185 McNear Dr., San Rafael, Calif. 94901; Marvin M. May, 10401 Wilshire Blvd., Los Angeles, Calif. 90024

[21] Appl. No.: 240,964

[22] Filed: Mar. 5, 1981

[51] Int. Cl.[3] ..... B21F 7/00; B21F 9/02; B21F 11/00; B21F 23/00

[52] U.S. Cl. ..... 140/93.6; 140/118; 140/119

[58] Field of Search ..... 140/54, 57, 93 A, 93.6, 140/118, 119, 122, 102.5, 93.2, 116, 120, 123, 149

[56] References Cited

U.S. PATENT DOCUMENTS

| | | | |
|---|---|---|---|
| 3,091,264 | 5/1963 | Stanford | 140/118 |
| 3,391,715 | 7/1968 | Thompson | 140/93.6 |
| 3,587,668 | 6/1971 | Ward | 140/93.6 |
| 3,593,759 | 7/1971 | Wooge | 140/93.6 |
| 3,880,204 | 4/1975 | Sarff et al. | 140/93 A |
| 4,117,872 | 10/1978 | Gott et al. | 140/57 |
| 4,252,157 | 2/1981 | Ohnishi | 140/93.6 |

*Primary Examiner*—Francis S. Husar
*Assistant Examiner*—Linda McLaughlin
*Attorney, Agent, or Firm*—John R. Murtha

[57] ABSTRACT

In a power tool for binding concrete-reinforcing bars together with a wire tie, a predetermined length of wire is fed into a pair of jaws having loop-forming grooves therein. A rotatable inner mandrel carries a cutter bar while an outer mandrel is rotatably mounted on the inner mandrel. Radial flanges on the outer mandrel form openings with the cutter bar for the passage of the wire as it is formed into a loop by the jaws. Relative rotation of the inner mandrel relative to the outer mandrel cuts the wire and then twists the cut ends into a wire tie that binds the reinforcing bar. Controls are provided for properly positioning the openings for the passage of the wire upon each successive cycle of operation.

15 Claims, 14 Drawing Figures

WIRE TYING POWER TOOL

The invention relates to a power tool for binding concrete-reinforcing bars together with wire. A predetermined length of wire is looped around the reinforcing bars by the tool. The wire is then cut and the ends of the wire twisted together to form a wire tie that binds the bars together.

In large concrete structures, such as bridges and office buildings, a great many steel reinforcing bars are required to reinforce the concrete. These reinforcing bars have to be carefully located in the concrete if they are to serve their function. It has been customary to bind the reinforcing bars together with wire to insure that the bars are not improperly displaced during the pouring of the liquid concrete. Heretofore, this binding of the reinforcing bars has been done by hand and, as a result, has been a time-consuming and costly operation. Although prior attempts have been made to develop a power tool to carry out the wire-binding operation, applicants are unaware of any such tool that has been successful in the field.

It is the object of the invention, therefore, to develop a portable power tool for binding reinforcing bars together with wire that will carry out the operation in a quick and efficient manner.

A preferred embodiment of the invention is shown in the accompanying drawings in which.

Figure 1:
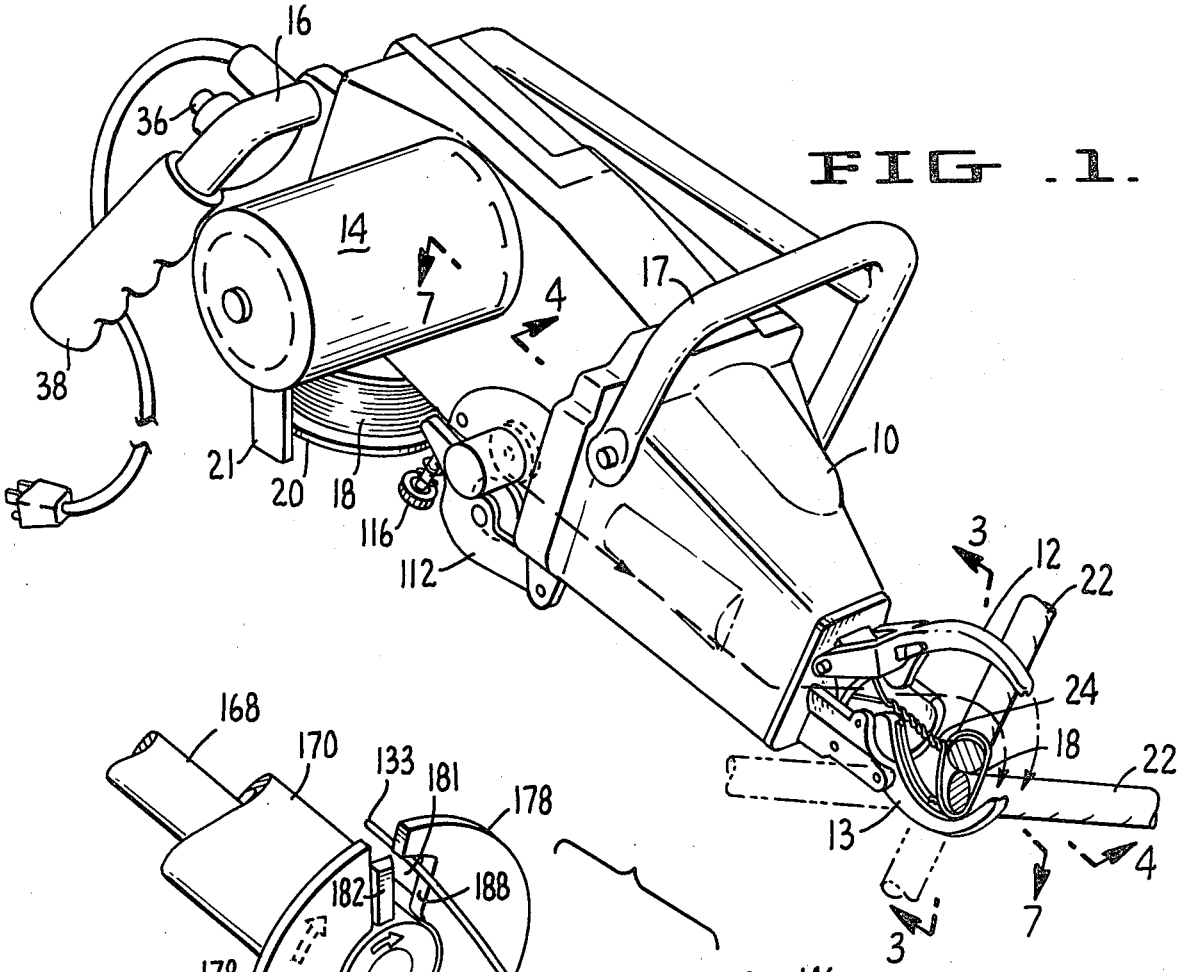
FIG. 1 is a perspective view of a wire-tying power tool constructed in accordance with the teachings of the invention.
Figure 2:
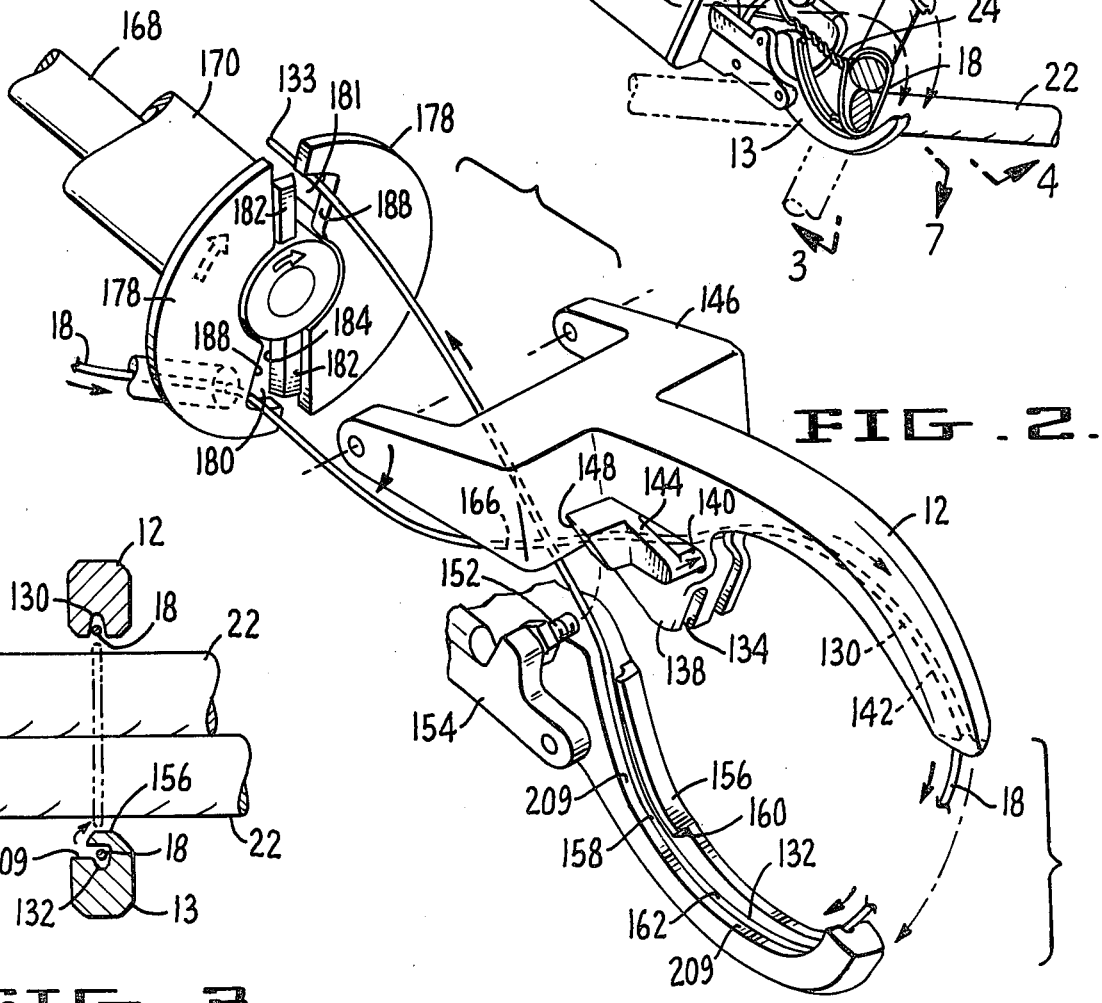
FIG. 2 is a partial, exploded view showing the relationships between the loop-forming jaws and the principal parts of the wire-twisting mechanism.
Figure 3:
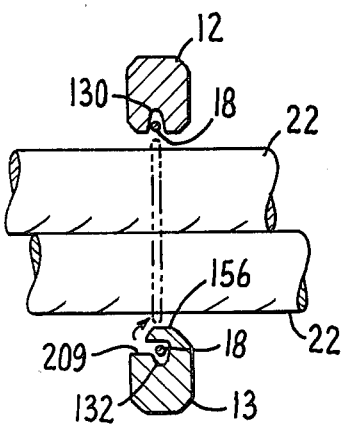
FIG. 3 is a partial view, partly in section, taken on the line 3—3 in FIG. 1 but with the loop-forming jaws closed.

As seen in FIG. 1, applicants' wire-tying tool generally comprises a main body housing 10 that is fitted with a pair of jaws 12,13 at its outer end, an electric motor 14 as a power source and hand-holding grips 16,17. A replaceable spool 20 of wire 18 is mounted in a U-shaped bracket 21 underneath the main housing 10 at the rear of the tool. In operation, the tool is held by the grips 16,17 and the normally opened jaws 12,13 are inserted around the reinforcing bars 22,22. The jaws 12,13 then close, a predetermined length of wire 18 is passed into the jaws and formed into a loop around the reinforcing bars 22,22, the end of the wire 18 is cut to length and the ends of the wire twisted to form a wire tie 24 that binds the reinforcing bars together.

The tool has an on/off switch (not shown) which permits the operator to turn on the electric motor 14. A worm gear 26 mounted on the motor's drive shaft 28 meshes with a larger worm wheel 30 fixed to the rearward end of the tool's main power shaft 32. Rotation of the main power shaft 32 is continuous. Power is only taken off the shaft intermittently through two conventional clutch assemblies 34,35 which normally are not engaged with the shaft 32.

Figures 4, 5, 6:
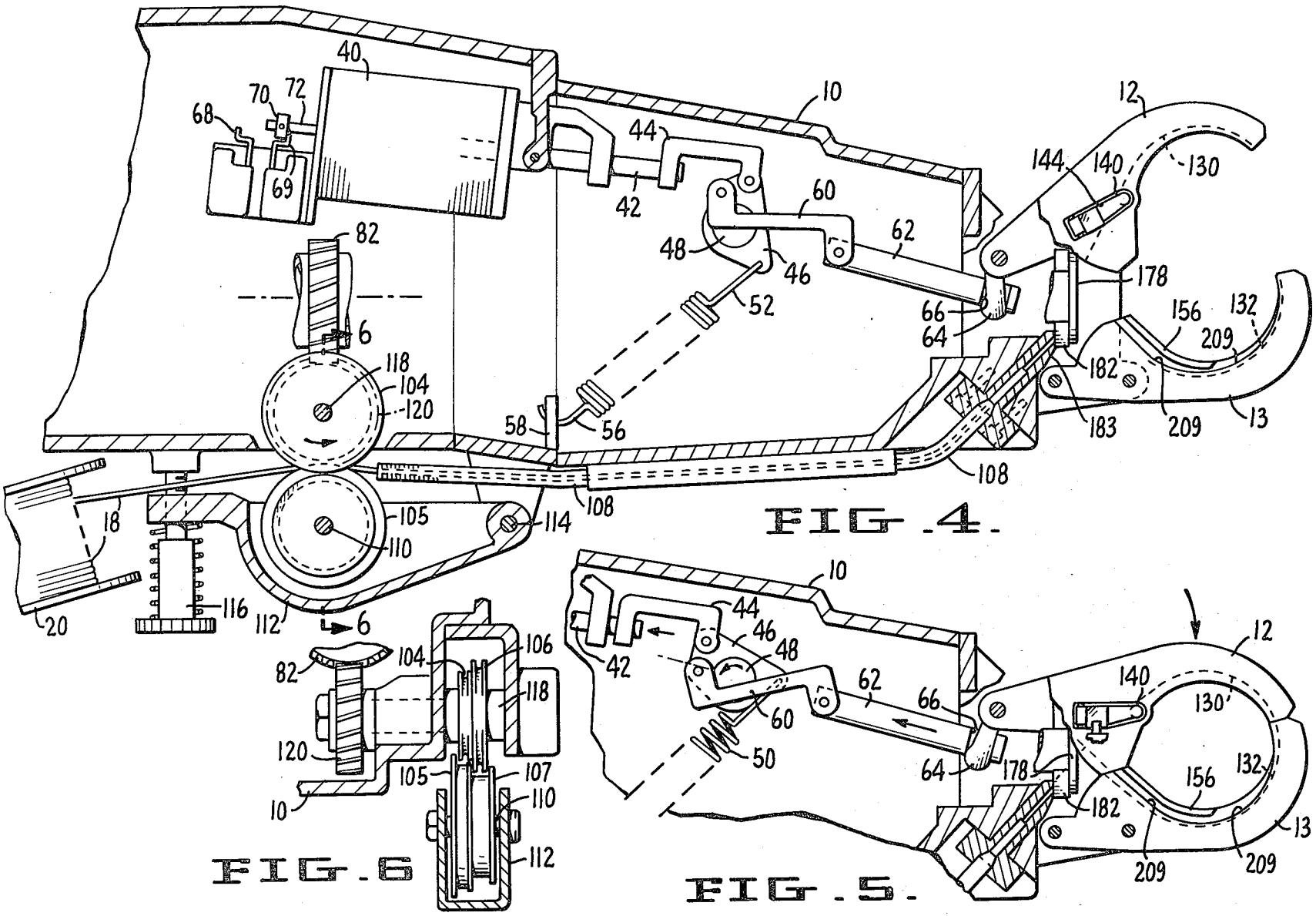
FIG. 4 is a partial, sectional view taken on the line 4—4 in FIG. 1 showing the jaw-closing and wire-feeding mechanisms.
FIG. 5 is a partial, sectional view similar to FIG. 4 showing the jaw-closing mechanism with the jaws closed.
FIG. 6 is a detailed view, partly in section, showing the wire feed rollers.
Figure 7:
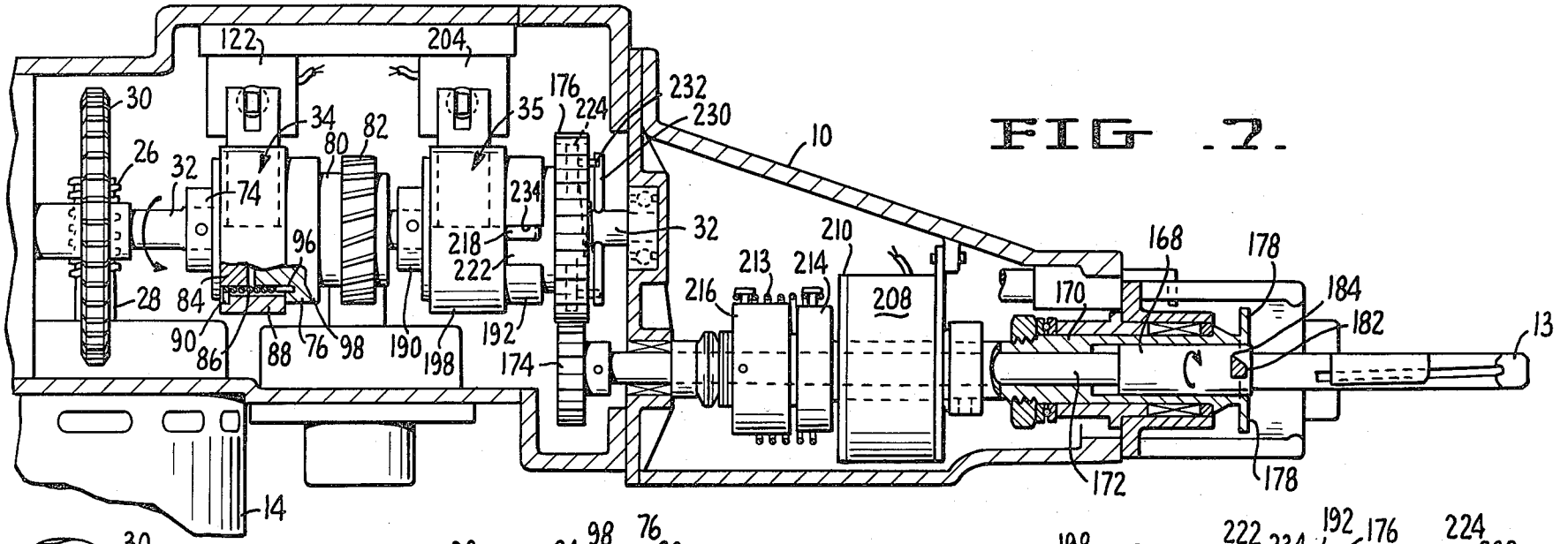
FIG. 7 is a sectional view taken on the line 7—7 in FIG. 1.
Figure 8B:
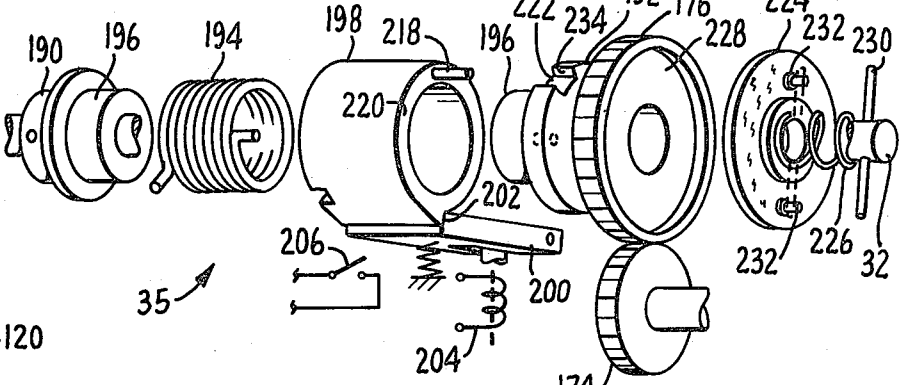
FIG. 8B is an exploded, detailed view of the wire-twisting clutch mechanism.
Figure 8A:
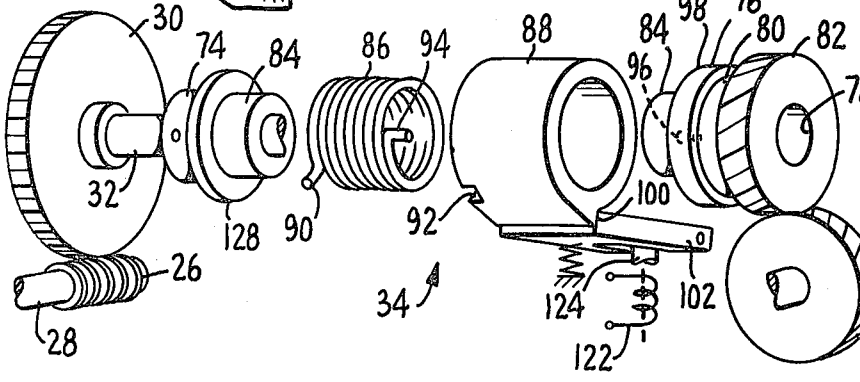
FIG. 8A is an exploded, detailed view of the wire-feed clutch mechanism.
Figure 14:
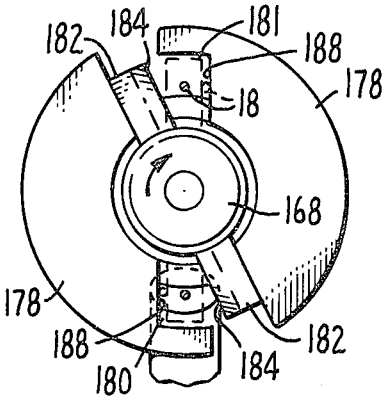
FIG. 14 is a view taken on the line 14—14 in FIG. 9.
Figure 13:
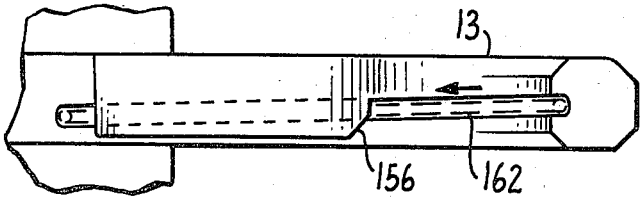
FIG. 13 is a view taken on the line 13—13 in FIG. 9.
Figure 12:
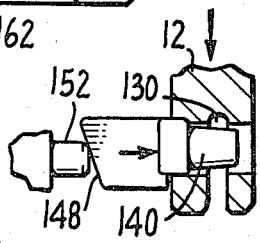
FIG. 12 is a view taken on the line 12—12 in FIG. 9.

The wire tying cycle of operation is initiated by the operator depressing a start button 36 located on the rearward grip 16 just above the hand-gripping portion 38. Location of the button is such that the cycle of operation can be started without the operator having to remove his hand from the grip. The button 36 is pressed and held depressed during the time the wire is looped around the reinforcing bars. Pressing the button 36 closes an electrical circuit which energizes a jaw-closing solenoid 40 pivotally mounted to the main housing 10. When the solenoid 40 is energized, the solenoid armature 42 is retracted inwardly (toward the left as viewed in FIG. 4). At its outer end, the armature 42 is fitted with a link 44 which connects it to a crank plate 46 that is mounted for rotation on a short stub shaft 48. The crank plate 46 is biased in a clockwise direction (as viewed in FIGS. 4 and 5) by a coil spring 50. One end 52 of the spring 50 hooks into the crank plate 46 while the opposite end 56 of the spring 50 is hooked into a stationary lug 58 on the inside of the tool housing 10. The crank plate is also secured to a flat-spring link, or connector 60, which connects the crank plate and a rod-like actuator 62 for the moveable jaw 12. A fixed lever arm 64 at the inward end of the moveable jaw 12 is lodged within a slot 66 machined in the forward end of the actuator 62. As the crank plate 46 is rotated counter-clockwise, the jaw actuator 62 pivots the fixed lever arm 64, and hence, the moveable jaw 12, in a clockwise direction causing the moveable jaw 12 to close down on the stationary jaw 13 as shown in FIG. 5. During the counter-clockwise rotation of the crank plate 46, the inner end of the spring link 60 passes beyond the center line of the actuator 62 and locks the moveable jaw in its closed position.

Figure 9:
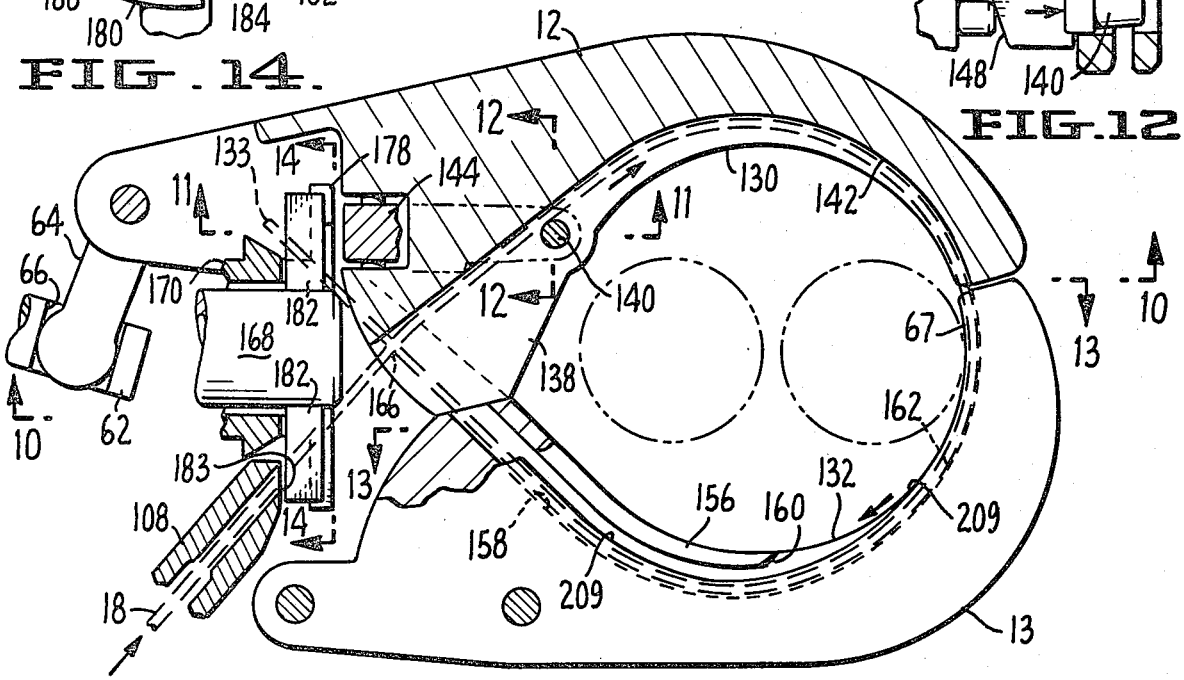
FIG. 9 is a detailed view, partly in section, of the loop-forming jaws in closed position.
Figure 11:
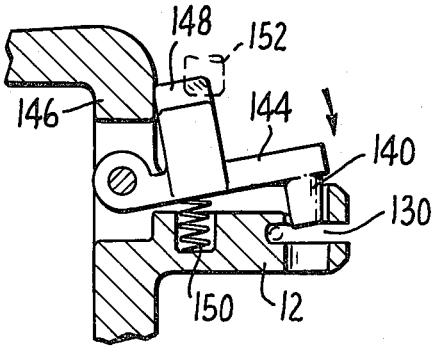
FIG. 11 is a view taken on the line 11—11 in FIG. 9.

As best seen in FIG. 9, the outer portion 67 of the stationary jaw 13 extends beyond the centerline of the loop formed by the jaws 12,13. The outer portion 67 forms a hook which the operator may use to pull the reinforcing bars 22,22 together in the event they are separated beyond the reach of the jaws.

Mounted at the rearward end of the solenoid 40 are a pair of trip switches 68,69. A complementary contact 70 is fixed to the inner end 72 of the solenoid amrature 42 and this contact engages the left, or rearward, trip switch 68 as the armature completes its jaw-closing retraction. Contact with the trip switch 68 completes an energizing circuit for the wire feed mechanism of the tool.

The wire feed mechanism is connected to the power shaft 32 of the tool through a wire feed clutch 34. This clutch comprises a driving drum 74 that is pinned to the power shaft 32 so as to continuously rotate with it. A second, similar driven drum 76 is provided. The driven drum 76 has a central opening 78 to accommodate the passage of the power drive shaft 32 therethrough. Sufficient clearance is provided so the rotation of the drive shaft does not rotate the driven drum. Secured to the driven drum 76 is a cylindrical extention 80 on which is mounted a helical gear 82. Both the drive drum 74 and driven drum 76 have opposite-facing, cylindrical bosses 84,84 of the same size, and mounted around these bosses is a coil spring 86 and a cylindrical spring collar 88. A radially extending tang 90, formed on the end of the coil spring 86 adjacent to the drive drum, is positioned in a slot 92 formed in one face of the collar 88. An axially extending tang 94, formed on the end of the spring 86 adjacent the driven drum, is positioned in an axial opening 96 in a flange 98 on the driven drum 76. In this way, the ends of the coil spring 86 are fixed to relatively moveable members—the driven drum 76 bearing the helical gear 82 and the spring collar 88. As long as the spring collar 88 is held against rotation relative to the driven drum 76, the diameter of the coils of the spring 86 is slightly greater than that of the bosses 84,84 on the two drums 74,76. Relative rotational movement between the driven drum 76 and the spring collar 88, however, twists the spring 86 causing the coils to contract down onto the bosses 84,84 and interconnect the driving drum 74 with the driven drum 76. The spring collar 88 is normally held against rotation by a single tooth 100 on its outer surface which is engaged by a solenoid actuated pawl 102.

The wire to tie the reinforcing bars is pulled from a replaceable spool 20 by feed rollers 104,105 and 106,107 that are driven for a predetermined angular rotation. Two sets of drive rolls are provided to give the option of two different wire feed lengths for use with different sized jaws. From the feed rollers 104,105 the wire 18 enters into a tubular conduit 108 that conducts the wire to the proper point for insertion in the loop-forming jaws 12,13. As is best seen in FIG. 6, the lower feed rollers 105,107 are mounted on a stub shaft 110 fixed in a narrow pod 112 that is pivotally mounted at its front end 114. An adjustable, spring-mounted tensioning screw 116 is provided at the rearward end of the pod 112 to permit the spacing between the feed rollers, and the tension of the wire, to be adjusted as desired. The upper, driving feed rollers 104,106 are fixed on a short shaft 118 that extends inwardly of the tool housing 10. A helical gear 120 is mounted on the end of the shaft 118 and meshes with the helical gear 82 on the driven drum 76 of the wire feed clutch mechanism 34.

Completion of the energizing circuit for the solenoid 122 by the engagement of the contact 70 on the armature 42 with the trip switch 68, causes the solenoid 122 to retract the stem 124 of the pawl 102 which serves as an armature for the solenoid. This action retracts the pawl 102 from engagement with the tooth 100 on the spring collar 88. The spring collar 88, which abuts the flange 128 on the drive drum 74, is then free to rotate with the drive drum 74 and power shaft 32. Rotation of the collar 88 relative to the driven drum 76 twists the coil spring 86 down upon the bosses 84,84 of the driving drum 74 and the driven drum 76. In this way, the clutch 34 is engaged with the power shaft 32 of the tool and the wire feed rollers 104,105 are rotated to advance the wire 18 into the jaws 12,13. The energizing circuit for the solenoid 122 is also provided with a timer (not shown) which automatically de-energizes the circuit after the clutch 34 has been engaged the correct number of revolutions to advance the desired length of wire. The spring biased pawl 102 then moves upwardly into a tooth-engaging position. When the spring collar 88 completes its last revolution the face of the tooth 100 engages the pawl 102 and stops the rotation of the spring collar 88. The spring 86 then twists in the opposite direction and the diameter of the coils increases to release the driven drum 76 from engagement with the drive drum 74. In this way, the wire feed clutch mechanism 34 serves to feed a predetermined length of wire into the loop-forming jaws 12,13.

Figure 10:
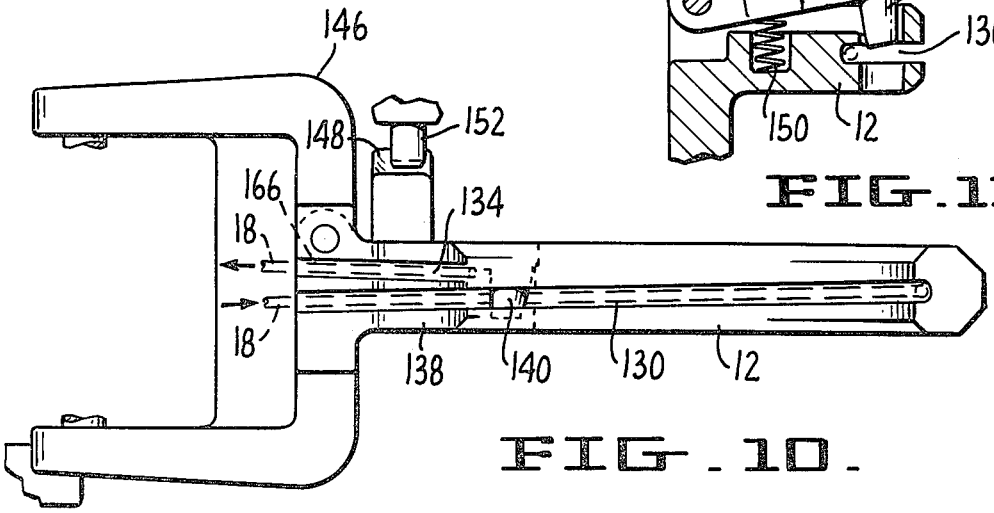
FIG. 10 is a view taken on the line 10—10 in FIG. 9.

The loop-forming jaws 12,13 are provided with wire-guiding grooves 130,132 at their inner surfaces. As the feed rolls 104,105 advance the wire 18 along the tubular conduit 108, the cut end 133 of the wire 18 is forced into the wire-guiding groove 130 formed in the upper, moveable jaw 12. Continued feed of the wire 18 causes the wire to advance in the groove 130 and to enter the wire-guiding groove 132 in the lower, fixed jaw 13. The cut end 133 of the wire 18 passes completely through the groove 132 in the lower jaw 13 and then is directed to a second wire-guiding groove 134 formed in the base portion 138 of the upper jaw 12. As is best seen in FIGS. 9 and 10, the wire-guiding grooves 130,132,134 are slightly canted so that the wire, when it exits from the groove 134, is directed across and to one side of the wire in the groove 130. The feeding motion of the wire 18 is such that the cut end 133 of the wire will pass completely through the grooves 130,132,134 in the jaws 12,13 and for a short distance beyond the end of the groove 134.

To insure proper feeding of the wire through the grooves, two wire-retaining devices are built into the jaws. The first is a retractable pin 140 on the upper jaw 12 that is positioned across the groove 130 at a point shortly prior to the start of the loop-forming curvature section 142 of the groove 130. The pin 140 is so spaced as to permit the wire 18 to pass between it and the jaw 12 in the groove 130. Its function is to retain successive portions of the wire in the groove as the cut end of the wire passes along the curved groove section. Because of the inherent stiffness of the wire, the curve in the wire imparted by the curved sections of the groove would cause the wire to pop out of the groove were the retaining pin not provided. The pin 140 thus serves as a fulcrum point to effect the necessary bending of the wire 18 to produce the initial curvature required to form a loop therein.

The pin 140 is adapted to assume its wire-retaining position only while the jaws 12,13 are closed. When the upper, moveable jaw 12 is open, the pin 140 is retracted to a non-operative positon. To this end, the pin 140 is formed at the outer end of a small lever arm 144 that is pivotally mounted within the yoke section 146 of the jaw 12. A cam surface 148 is formed on the lever arm 144 on a side opposite that of the pin 140. A spring 150 biases the lever arm 144 in a pin-retracting direction. As the upper jaw 12 is pivoted downwardly toward a closed position with the lower jaw 13, the cam surface 148 on the lever arm 144 engages a stop 152 fixed to the lower jaw 13 at its inner end 154. As the upper jaw continues downwardly, the stop 152 cams the lever arm 144, and hence the pin 140, into its wire-retaining position across the open end of the groove 130. In reverse, upward movement of the jaw 12 frees the lever arm 144 to move to a pin-retracting position under the urging of the spring 150 once the cam surface 148 has cleared the stop 152.

The second wire-retaining device is a lip section 156 formed on the lower jaw 13 as a cover over the terminal portion 158 of the groove 132. The leading edge 160 of this lip 158 begins shortly before the loop-forming curvature 162 of the groove 130 ends and controls the final, straight portion 158 of the groove 132. It is the function of this lip section 156 to re-straighten the cut end 133 of the wire 18 after it has been shaped into a loop by the curved sections 142,162 of the grooves 130,132. Were the lip 156 not provided, the curvature imparted to the cut end 133 of the wire 18 would cause it to exit out of the groove 130 in a continuing curve tending to bend back on itself. The lip, however, restraightens the wire 18 and causes it to exit from the jaw 13 in a direction that crosses over the opposite end 166 of the wire and positions the wire for the final wire-twisting action.

After the desired amount of wire has been fed into the jaws and looped around the reinforcing bars 22,22, the operator releases the button 36 and the jaw-closing solenoid 40 is deenergized. The coil spring 50 then rotates the crank plate 46 in a clockwise direction and this rotation causes the link 60 to move the actuator 62 outwardly of the tool housing 10. Outward movement of the actuator 62 pivots the upper jaw 12, through engagement with lever arm 64, to its upper, open position. As the armature 42 of the jaw-closing solenoid 40 moves outwardly, the contact 70 at the inner end of the armature engages the right, or inward, trip switch 69 and initiates the cut-off of the wire 18 and the twisting of the wire ends.

These operations are performed by rotatable, inner and outer mandrels 168,170 located at the forward end of the tool housing 10 immediately behind the loop-forming jaws 12,13. The inner mandrel 168 is fixed to a long shaft 172 that extends rearwardly of the housing and the shaft 172 carries a spur gear 174 that meshes with a larger spur gear 176 on the clutch mechanism 35. Thus, the shaft 172 and inner mandrel 168 are connected with the power shaft 32 of the tool whenever the clutch mechanism 35 is engaged.

The outer mandrel 170 is loosely mounted on the inner mandrel 168 and the long shaft 172 so as to permit relative rotational movement therebetween and, at its outer end, is provided with two radial flange sections 178,178. Each flange section 178 is cut away to form an opening 180,181 that serves as a "window" for the passage of the wire 18. These openings, or windows 180,181, are oppositely disposed to each other and one, 180, allows the passage of the wire into the jaws 12,13 while the other, 181, allows the cut end 133 of the wire 18 to exit therethrough. A cutter bar 182 is mounted at the outer end of the inner mandrel 168 in the same plane as the flanges 178,178 on the outer mandrel 170. The leading edges 184,184 of the cutter bar 182 are given a sharp edge so the cutter bar will cut the feed wire after it has been fed into the loop-forming jaws as the cutter bar 182 passes across the hollow die 183 at the forward end of the wire-guiding conduit 108. After the blade of the cutter bar 182 has cut the wire at the hollow die 183, both blades press the ends of the wire sideways against the sides 188,188 of the openings 180,181. Further rotation of the mandrels 168,170 then serves to twist the ends of the wire 18 to form a wire tie 24 binding the reinforcing bars 22,22.

When the contact 70 engages trip switch 69 the twist clutch 35 is engaged and the power shaft 32 is connected with the long shaft 172 and inner mandrel 168. The twist clutch 35 is similar to the wire feed clutch 34. It has a drive drum 190, a driven drum 192 which is attached to the gear 174, a coil spring 194 that fits over the bosses 196,196 on the drive and driven drums, and a spring collar 198. Rotation of the spring collar 198 is prevented by a spring-biased pawl 200 that engages a tooth 202 formed on the surface of the collar 198. Engagement of the contact 70 with the trip switch 69 energizes the solenoid 204 and the solenoid 204 retracts the pawl 200 from engagement with the spring collar 198. Release of the collar 198 allows the coil spring 194 to tighten down on the bosses 196,196 as previously described with respect to spring 86 and connects the drive drum 190 with the driven drum 192.

As the pawl 200 is retracted from engagement with the tooth 202 on the spring collar 198 it contacts a switch 206 completing a circuit that energizes a magnetic drag brake. A stationary brake disc 208 slidably engages an armature 210 fixed to the outer mandrel 170 and the drag thereby imparted to the outer mandrel 170 causes the inner mandrel 168 to rotate relative to the outer mandrel. During this relative rotation between the two mandrels, the cutter bar 184 on the inner mandrel 168 cuts the feed wire 18 and then pinches the ends of the wire sideways against the sides 188,188 of the openings 180,181. Once this condition is attained the two mandrels rotate together to twist the ends of the wire into a tie that binds the reinforcing bars. The initial rotation of the wire ends twists the wire loop laterally out of the groove 132 in the stationary jaw 13. For this purpose, one side wall of the groove 132 is cut away at 209 to permit lateral movement of the wire 18 out of the groove 132. The number of twists imparted to the wire is controlled by an adjustable timer (not shown) in the twist clutch circuitry. This timer can be manually adjusted to provide any desired number of twists to obtain the proper tightness of the tie regardless of the diameter of the reinforcing bars 22,22. After the preselected time period has expired, the timer deenergizes the solenoid 204 allowing the pawl 200 to again contact the tooth 202 on the spring collar 198. The diameter of the coil spring 194 expands slightly and disengages the driven drum 192 from the drive drum 190. The inner mandrel 168 and long shaft 172 are thereby disengaged from the power shaft 32 and the mandrels 168, 170 stop their rotation.

At the same time, the lifting of the pawl 200 to engage the spring collar 198 opens the switch 206 in the brake circuit and disengages the magnetic brake disc 208 from the brake armature 210. A torsion spring 213 has one end anchored to a hub 214 that is fixed to the outer mandrel 170 and an opposite end connected to a similar hub 216 pinned to the long shaft 172. When the brake is disengaged the torsion spring 213 rotates the outer mandrel 170 approximately 15° in advance of the inner mandrel 168 thereby moving the sides 188,188 of the openings 180,181 away from the cutter bar 184. This motion releases the ends of the twisted wire tie and re-forms the openings 180,181 for the passage of wire during the next cycle of operation of the tool.

The openings 180,181 must be properly positioned opposite the grooves 130,134 in the jaw 12 in order to pass the next successive length of wire. Accordingly, the twist clutch 35 is constructed to always position the inner mandrel 168 in the same location upon completion of each successive twisting operation. A locating pin 218 is fixed to the forward face 220 of the spring collar 198. The pin 218 extends into a rectangular slot 222 formed in the outer periphery of the driven drum 192.

Since the at-rest position of the collar 198 is precisely fixed by engagement of the pawl 200 with the tooth 202, the pin 218 in the slot 222 insures that the gear 176, and hence the inner mandrel 168, will always stop within a few degrees of rotation of the same location upon the completion of each cycle of operation. Further precision is insured by providing the gear 176 with a drag brake. The brake comprises a brake disc 224 mounted loosely on the power shaft 32. A spring 226 urges the disc 224 into engagement with the inner surface 228 of the gear 176. The disc 224 is driven by a bar 230 fixed to the shaft 32 which engages two axial pins 232,232 on the disc. As a result of the drag placed on the gear by this brake, the pin 218 on the collar 198 is always engaged with the side surface 234 of the slot 222 and precisely positions the gear 176, and hence the inner mandrel 168, in the same position at the end of each operating cycle. In this way the openings, or "windows" 180,181, are properly positioned for the next cycle of operation.

We claim:

1. A tool for binding with wire reinforcing bars used in concrete structures, said tool comprising:

(a) a pair of jaws relatively movable toward and away from each other between open and closed positions for insertion around two or more reinforcing bars, (b) means for selectively moving said jaws between their open and closed positions, (c) said jaws having grooves formed therein in the configuration of a loop when the jaws are in their closed position, (d) means for feeding a predetermined length of wire having a free end into the grooves when the jaws are in their closed position, (e) wire-retaining means on the jaws for blocking the exit of the wire from the grooves during the feeding of the wire into the grooves in the jaws, (f) means for cutting the wire after it has been fed all the way into the grooves in the jaws, and (g) means for twisting the cut ends of the wire to form a tie for binding the reinforcing bars.

2. A tool as set forth in claim 1 wherein the wire-retaining means on one of said jaws is removed from its wire-retaining position as the jaws move from their closed position to an open position.

3. A tool as set forth in claim 2 wherein the wire-retaining means on the other of said jaws is adapted to permit the escape of the wire from the grooves by lateral movement of the wire during the twisting of the cut ends of the wire.

4. A tool as set forth in claim 3 wherein the grooves in the jaws have sections that are substantially straight and sections that are curved and said wire-retaining means are positioned adjacent the transition points between the straight and curved sections of the grooves.

5. A tool as set forth in claim 4 wherein the wire-retaining means on one of said jaws comprises a retractable pin and the wire-retaining means on the other of said jaws comprises a lip covering the terminal portion of the groove in the jaw.

6. A tool as set forth in claim 4 wherein one of said jaws is stationary.

7. A tool as set forth in claim 5 wherein the groove adjacent the lip is cut away to permit lateral movement of the wire out of the groove.

8. A tool for binding with wire reinforcing bars used in concrete structures, said tool comprising:

(a) a pair of jaws relatively movable toward and away from each other between open and closed positions for insertion around two or more reinforcing bars, (b) means for selectively moving said jaws between their open and closed positions, (c) said jaws having grooves formed therein in the configuration of a loop when the jaws are in the closed position, (d) a pair of relatively rotatable members forming a pair of openings therebetween, (e) means for feeding a predetermined length of wire having a free end through one of the openings between said relatively rotatable members, into the grooves in the jaws while the jaws are closed, and the free end of the wire through the other of said openings between the relatively rotatable members, (f) means for causing one of said relatively rotatable members to rotate relative to said other member to close the openings therebetween, said one member having a cutter thereon to cut the wire and to twist the cut ends of the wire into tie for binding the reinforcing bars upon further rotation of said members.

9. A tool as set forth in claim 8 wherein said relatively rotatable members are rotated to cut and twist the wire as the jaws move from a closed to an open position.

10. A tool as set forth in claim 9 wherein said relatively rotatable members comprise an inner mandrel and an outer mandrel rotatable thereon and said inner mandrel is provided with a cutter bar and said outer mandrel is provided with radial flanges in line with said cutter bar.

11. A tool as set forth in claim 10 wherein means are provided for normally rotating said outer mandrel relative to said inner mandrel so as to provide openings between said cutter bar and radial flanges.

12. A tool as set forth in claim 11 wherein brake means are provided for selectively applying a drag to rotation of the outer mandrel so as to cause the inner mandrel to rotate relative to the outer mandrel and close the openings between the cutter bar and radial flanges.

13. A tool as set forth in claim 12 wherein the tool is provided with means for stopping the inner mandrel at the end of each cycle of operation in the same position it occupied at the start of the cycle.

14. A tool as set forth in claim 13 wherein said means for normally spacing the outer mandrel relative to the inner mandrel operates to provide openings between said cutter bar and said radial flanges after the inner mandrel has been stopped in its original position at the end of the cycle of operation.

15. A tool for binding with wire reinforcing bars used in concrete structures, said tool comprising:

(a) a stationary jaw, (b) a moveable jaw moveable toward and away from said stationary jaw between open and closed positions, (c) said jaws having grooves formed therein in the configuration of a loop when the jaws are in the closed position, (d) means for selectively moving said moveable jaw between the open and closed positions, (e) relatively rotatable members including an inner mandrel and an outer mandrel rotatable thereon, (f) said inner mandrel having a cutter bar and said outer mandrel having radial flanges in line with the cutter bar, (g) means for normally rotating said outer mandrel relative to the inner mandrel so as to provide a pair of openings between said cutter bar and radial flanges, (h) means for feeding a predetermined length of wire having a free end through one of the openings between said inner and outer mandrels into the grooves in jaws while the jaws are in their closed position and the free end of the wire through the other of said openings, (i) brake means for selectively applying a drag to rotation of the outer mandrel to cause the cutter bar to cut the wire and pinch the wire ends against the radial flanges on the outer mandrel, and (j) means for automatically opening the jaws and rotating said inner and outer mandrels to twist the ends of the wire into a binding tie.

* * * * *